US006287160B1

(12) United States Patent
Onoue

(10) Patent No.: US 6,287,160 B1
(45) Date of Patent: Sep. 11, 2001

(54) TILT AND TRIM ARRANGEMENT FOR MARINE PROPULSION

(75) Inventor: Akihiro Onoue, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/428,094

(22) Filed: Oct. 27, 1999

(30) Foreign Application Priority Data

Oct. 27, 1998 (JP) ..... 10-306186

(51) Int. Cl.[7] ..... B63H 5/125
(52) U.S. Cl. ..... 440/61
(58) Field of Search ..... 440/53, 61; 91/167 R, 91/170 R, 173, 422; 92/61

(56) References Cited

U.S. PATENT DOCUMENTS

| | | | | |
|---|---|---|---|---|
| 2,953,335 | * | 9/1960 | Kiekhaefer | 440/61 |
| 4,501,562 | * | 2/1985 | Blanchard | 440/61 |
| 4,557,696 | | 12/1985 | Nakahama . | |
| 5,149,286 | | 9/1992 | Tsujii . | |
| 5,156,561 | * | 10/1992 | Kinoshita | 440/61 |
| 5,195,914 | * | 3/1993 | Binversie et al. | 440/56 |
| 5,215,484 | * | 6/1993 | Saito | 440/61 |
| 5,746,055 | | 5/1998 | Nakamura et al. . | |
| 5,784,943 | * | 7/1998 | Kahra | 91/28 |

FOREIGN PATENT DOCUMENTS

| | | | | |
|---|---|---|---|---|
| 234095 | * | 11/1985 | (JP) | 440/61 |
| 101295 | * | 4/1989 | (JP) | 440/61 |
| 230893 | * | 1/1992 | (JP) | 440/61 |
| 404005194 | * | 1/1992 | (JP) | 440/61 |

* cited by examiner

*Primary Examiner*—S. Joseph Morano
*Assistant Examiner*—Ajay Vasudeva
(74) *Attorney, Agent, or Firm*—Knobbe, Martens, Olson & Bear, LLP

(57) ABSTRACT

A tilt and trim arrangement for marine propulsion includes an improved construction. A swivel bracket, which carries a drive unit for pivotal movement about a steering axis includes a pair of ribs spaced apart transversely from each other. A clamping bracket is affixed to an associated watercraft and supports the swivel bracket for pivotal movement about a tilt axis. A hydraulic tilt device is provided for tilting the swivel bracket. The tilt device includes a cylinder housing, a piston slidably supported within the housing and a piston rod affixed to the piston. The cylinder housing has an upper section with a diameter that is smaller than a lower section, and the piston rod extends outwardly from the upper section. The piston rod is pivotally affixed to the ribs. The upper section of the cylinder housing is generally positioned between the ribs at least when the piston rod is fully retracted within the cylinder housing.

22 Claims, 10 Drawing Sheets

TILT AND TRIM ARRANGEMENT FOR MARINE PROPULSION

BACKGROUND OF THE INVENTION

1. Field of the Invention

This invention relates to a tilt and trim arrangement for a marine propulsion, and more particularly to an improved tilt and trim arrangement that is reinforced against external force while remaining compact.

2. Description of Related Art

Marine outboard drives, i.e., both outboard motors and the outboard drive sections of inboard motors, have drive units mounted on an associated watercraft by a tilt and trim arrangement or bracket assembly which comprises a swivel bracket and a clamping bracket. The swivel bracket carries the outboard drive unit for pivotal movement about a generally vertically extending steering axis. The clamping bracket, in turn, is affixed to the associated watercraft and supports the swivel bracket for pivotal movement about a generally horizontally extending tilt axis.

The bracket assembly includes a hydraulic tilt device disposed between the swivel bracket and the clamping bracket so that the swivel bracket is tilted up or down relative to the clamping bracket. The hydraulic tilt device is, for example, a compound tilt and trim cylinder assembly.

The hydraulic tilt device includes a cylinder assembly having a cylinder housing which defines a cavity therein. A piston is slidably supported in the cavity. A piston rod is affixed to the piston and extends beyond the cavity. The swivel bracket has a pair of ribs spaced apart transversely from each other and a pivot pin extends between them. The piston rod is affixed on the pivot pin for pivotal movement. Meanwhile, the clamping bracket also has a pair of ribs spaced apart transversely from each other and another pivot pin extends between them. The cylinder housing is affixed on this pivot pin for pivotal movement. A powering assembly is provided for pressurizing working fluid in the cavity of the cylinder housing. The powering assembly includes an electric motor, a hydraulic pump and a reservoir, all of which are relatively bulky. With the reciprocal movement of the piston in the cavity of the cylinder housing, the piston rod extends from or contracts into the housing and the drive unit, thereby, is tilted up or down in a certain range.

Recently, outboard motors are inclined to have larger engines than before because more powerful and high speed propulsions are desired. This trend necessarily invites large sized drive units to support such large engines which are quite heavy as well as unwieldy. In addition, these outboard motors produce large thrust force. The bracket assembly accordingly must support a heavy drive unit and receive such a large thrust force. The ribs and hydraulic tilt assembly need to be bigger and have more sufficient rigidity in order to withstand the increased weight of the drive and the increased spacing necessary to receive the larger powering assembly. In fact, the bulky cylinder housing and powering assembly are likely to cause a problem as to how they are disposed in a limited space between the rigid ribs.

Some conventional bracket assemblies have a cylinder assembly and a powering assembly positioned side-by-side to each other. However, a cylinder housing of this cylinder assembly must be off-centered and hence produces a torque upon the ribs when the cylinder extends and contracts. Thus, the ribs require reinforcement and, if reinforced, they are larger, which further exacerbates the arrangement of the cylinder and powering assembly between the clamping and swivel brackets.

Other conventional bracket assemblies have a cylinder housing spaced widely from the swivel bracket. This arrangement, however, does not present a compact bracket assembly.

SUMMARY OF THE INVENTION

A need therefore exists for a compact tilt and trim arrangement for a marine propulsion with sufficiently reinforced ribs to support larger outboard motors.

In accordance with one aspect of the present invention, a tilt and trim arrangement for a marine outboard drive comprises a swivel bracket carrying a drive unit for pivotal movement about a generally vertically extending axis. The swivel bracket is provided and includes a pair of ribs spaced apart transversely from each other. A clamping bracket is adapted to be affixed to an associated watercraft and supports the swivel bracket for pivotal movement about a generally horizontally extending axis. A hydraulic tilt device is provided and includes a cylinder housing defining a cavity therein. A piston assembly is slidably supported in the cavity. A piston rod is affixed to the piston assembly and extends beyond the cavity. The cylinder housing includes a tilt section and a trim section. An outer diameter of the tilt section is smaller than an outer diameter of the trim section. The piston rod extends within the tilt section. A first pivotal connection couples the piston rod to the swivel bracket at a position generally between the ribs. Second pivotal connection couples the cylinder housing to the clamping bracket. The tilt section is generally positioned between the ribs of the swivel bracket at least when the piston rod exists almost fully within the cylinder housing.

In accordance with another aspect of the present invention, a tilt and trim arrangement for a marine outboard drive comprises a swivel bracket carrying a drive unit for pivotal movement about a generally vertically extending axis. A clamping bracket is adapted to be affixed to an associated watercraft and supports the swivel bracket for pivotal movement about a generally horizontally extending axis. A tilt and trim device is provided and includes a housing having a tilt section and a trim section. An outer diameter of the tilt section is smaller than an outer diameter of the trim section. The tilt section defines a tilt cavity and has a tilt piston slidably movable within the tilt cavity. The trim section defines a trim cavity and has a trim piston slidably movable only within the trim cavity. An inner diameter of the tilt cavity is smaller than an inner diameter of the trim cavity. A piston rod is affixed to the tilt piston and extends beyond the tilt cavity. A first pivotal connection couples the piston rod to the swivel bracket, and a second pivotal connection couples the cylinder to the clamping bracket. Both the trim piston and the tilt piston move as a unit to move the drive unit in a trim range and only the tilt piston moves to move the drive unit in a tilt range. The swivel bracket has a pair of ribs spaced apart transversely relative to each other. The tilt section is generally positioned between the ribs at least when the piston rod exists almost fully within the cylinder.

In accordance with a further aspect of the present invention, a tilt and trim arrangement for a marine outboard drive comprises a swivel bracket carrying a drive unit for pivotal movement about a vertically extending steering axis. The swivel bracket is provided and includes a pair of ribs spaced apart transversely from each other. A clamping bracket is adapted to be affixed to an associated watercraft and supports the swivel bracket for pivotal movement about a horizontally extending tilt axis. A tilt and trim device is placed between the swivel bracket and the clamping bracket for tilting the swivel bracket. The tilt and trim device includes a cylinder housing which defines a cavity therein. A piston is slidably supported in the cavity and a piston rod is affixed to the piston. The cylinder housing has a lower section and an upper section which diameter is smaller than the lower section. The piston rod extends outwardly from the upper section and is affixed to the ribs for pivotal movement. The upper section is generally positioned between the respective ribs at least when the piston rod is fully retracted within the cylinder housing.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention.

DETAILED DESCRIPTION OF THE PREFERRED EMBODIMENT OF THE INVENTION

Figure 1:
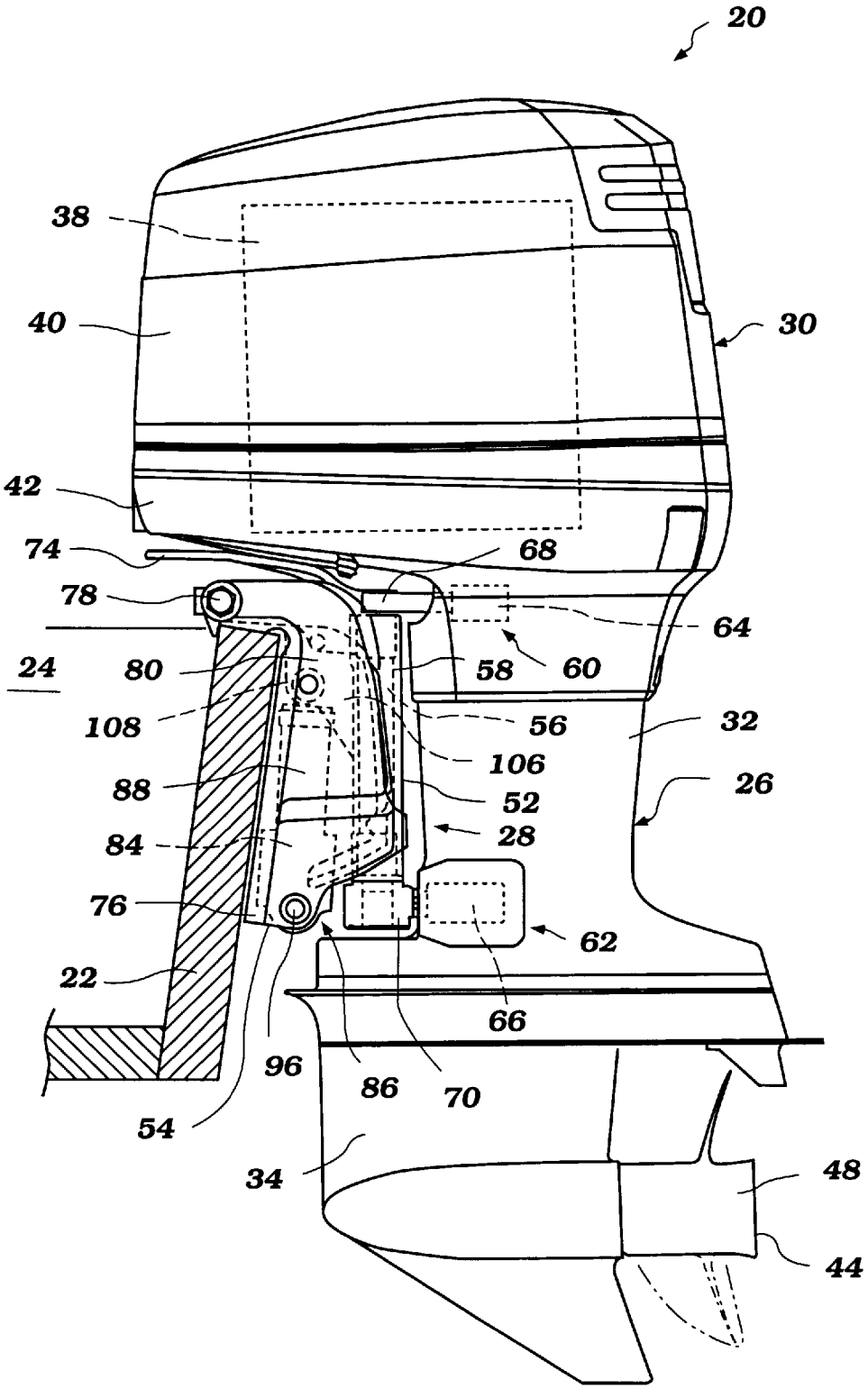
FIG. 1 is a side elevational view showing an outboard motor including a tilt and trim arrangement in accordance with an embodiment of the present invention. The outboard motor is illustrated as attached to the transom of an associated watercraft, which is shown partially in section and is illustrated in a fully trimmed down position.

With reference initially to FIGS. 1 through 4, the general overall environment of an exemplary outboard motor and a tilt and trim arrangement will be described. Although the invention is described in conjunction with an outboard motor, various aspects of the tilt and trim adjustment mechanism can be used with other types of outboard drives, such as, for example, the outboard drive portion of an inboard/outboard drive. Other usages will also be readily apparent to those skilled in the art.

An outboard motor 20 is shown as attached to a transom 22 of an associated watercraft 24. In connection with the following description, the terms "front," "forward" and "forwardly" means at or toward the side where the clamping bracket 54 is affixed to the transom 22 of the associated watercraft 24 and the terms "rear" and "rearwardly" mean at or toward an opposite side of the front side unless stated otherwise.

The outboard motor 20 generally comprises a drive unit 26 and a tilt and trim arrangement 28. The drive unit 26 comprises a power head 30, a driveshaft housing 32 and a lower unit 34. The power head 30 is disposed atop the drive unit 26 and includes an internal combustion engine 38, a top cowling 40 and a bottom cowling 42. The engine 38 powers a propulsion device such as a propeller 44 disposed at the lowermost portion of the drive unit 26 and, therefore, the engine desirably has a crankshaft extending generally vertically, as is conventional in the art. The top and bottom cowlings 40, 42 generally completely encircle the engine 38 so as to protect it. For instance, water is prevented from splashing over the engine 38. The top cowling 40 is detachably affixed to the bottom cowling 42 so as to ensure access to the engine 38 for maintenance.

The driveshaft housing 32 depends from the power head 30 and supports a driveshaft which is driven by the crankshaft of the engine 38. The driveshaft extends generally vertically through the driveshaft housing 32. The driveshaft housing 32 also has some sections of an exhaust system through which exhaust gasses from the engine 38 pass and flow down to the lower unit 34.

The lower unit 34, in turn, depends from the driveshaft housing 32 and supports a propeller shaft which is driven by the driveshaft. The propeller shaft extends generally horizontally through the lower unit 34. The propeller 44 is affixed at the end of the propeller shaft and is driven by the propeller shaft. A bevel gear transmission is provided between the driveshaft and the propeller shaft. The transmission crosses these two shafts generally normal to each other (i.e., the transmission couples together the two shafts at generally a 90° shaft angle). The lower unit 34 has also a discharge section of the exhaust system. The majority of the exhaust gasses are finally discharged to the body of water surrounding the outboard motor 20 through a hub 48 of the propeller 44 under normal running conditions.

The tilt and trim arrangement 28 comprises a swivel bracket 52 and a clamping bracket 54. The swivel bracket 52 carries the drive unit 32 for pivotal movement about a generally vertically extending axis, i.e., an axis of a steering shaft 56. The steering shaft 56 passes through a steering shaft housing section 58 of the swivel bracket 52 and extends beyond the top end and the bottom end of the steering shaft housing section 58. A pair of upper mount assemblies 60 and a pair of lower mount assemblies 62 are affixed at both upper sides and lower sides of the driveshaft housing 32. The upper and lower mount assemblies 60, 62 include mount sections 64, 66 and support sections 68, 70. The support sections 68, 70 extend forwardly from the mount sections 64, 66 which are affixed to the driveshaft housing 32. The support sections 68, 70 have bores into which the steering shaft 56 is fitted. The bores of the support sections 68, 70 and the steering shaft 56 are joined together by spline connections. Because the steering shaft 56 is thus unified with the support sections 68, 70, the swivel bracket 52 supports the driveshaft housing 32 for pivotal movement about the axis of the steering shaft 56. A steering arm 74 extends forwardly from the upper support section 68 to be steerable by an operator of the outboard motor 20.

The clamping bracket 54, in turn, is affixed to the transom 22 of the associated watercraft 24 with a pair of clamping sections 76. The clamping bracket 54 supports the swivel bracket 52 for pivotal movement about a generally horizontally extending axis, i.e., an axis of a tilt shaft or pivot pin 78. The clamping bracket 54 has a pair of ribs 80 that extend generally rearwardly from the clamping sections 76. The ribs 80 extend generally vertically from almost the top to the bottom of the clamping bracket 54. The ribs 80 include upper portions 81 and lower portions 82. The distance between the upper portions 81 is greater than a distance between the lower portions 82, as best understood from FIG. 3. The tilt shaft 78 is pivotally supported in bores generally formed at the top ends of the ribs 80.

The tilt and trim arrangement 28 includes a hydraulic tilt device 84 for tilting up and down the drive unit 32 about the axis of the tilt shaft 78. The tilt movement actually includes a trim adjusting movement and a tilt movement, which is in the narrow sense of the word. That is, the drive unit 26 moves in a trim adjusted range in which the propeller 44 is generally in the body of water surrounding the outboard motor 20 to propel the associated watercraft 24. The movement of the drive unit 26 in this range, therefore, can adjust a trim angle of the drive unit 32. The hydraulic tilt device 84 in this range, however, must work against the thrust force, in addition to the weight of the outboard motor 20, in order to trim up the outboard drive unit 32. The drive unit 26 also moves in a tilt range which is higher than the trim adjusted range. The propeller 44 in this tilt range is generally (but not always) out of the body of water for storage or transportation, or simply to raise the propeller out of the water when running in shallow water or to avoid in-water articles (e.g., rocks, logs, fishing nets, etc.). The hydraulic tilt device 84 in the tilt range only works against the weight of the outboard motor 20 when raising the drive unit 32 in this range.

The hydraulic tilt device 84 generally comprises a cylinder assembly 86 and a powering assembly 87. The cylinder assembly 86 is disposed generally between the lower portions 82 of the clamping bracket ribs 80. Although an internal construction of the hydraulic tilt device 84 will be described later with reference to FIG. 8, the cylinder assembly 86 includes a cylinder housing 88, a piston assembly and a piston rod 90. The cylinder housing 88 has a cavity therein and the piston assembly is slidably supported in the cavity of the cylinder housing 88. The piston rod 90 is affixed to the piston assembly and extends beyond the cavity. The longitudinal axis of the cylinder housing 86 generally is aligned in a transverse direction (i.e., side to side) with a center axis of the tilt and trim arrangement 28 as seen in FIG. 3.

Figure 3:
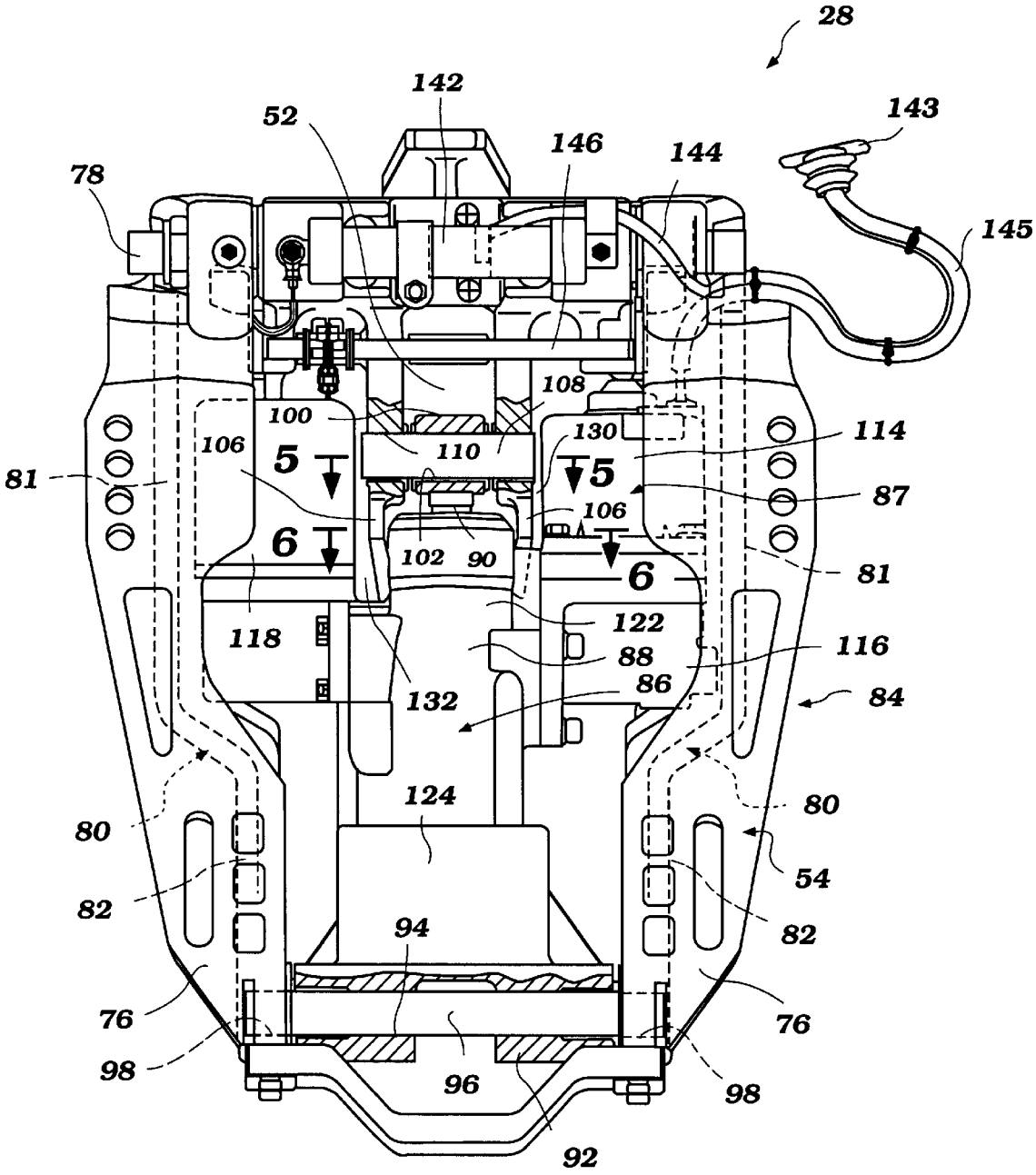
FIG. 3 is an enlarged front elevational view showing the tilt and trim arrangement. A piston rod shown in this figure exists almost fully within a cylinder housing. Pivotal mounts of the piston rod and the cylinder housing are shown partially in section.

As best seen in FIG. 3, the cylinder housing 88 has a trunnion 92 through which a bore 94 is formed transversely. A pivot pin 96 is fitted into the bore 94 and both ends of the pivot pin 96 are journaled by openings 98 formed at both lowermost ends of the ribs 80 of the clamping bracket 54. This coupling between the cylinder housing 88 and the lowermost ends of the ribs permits pivotal movement of the cylinder housing 88 relative to the clamping bracket 54.

The piston rod 90 has an eyelet 100 provided with a bore 102. The swivel bracket 52 has a pair of ribs 106 extending forwardly generally from the steering shaft housing section 58. Another pivot pin 108 is journaled by openings 110 formed at both of the ribs 106. The pivot pin 108 provides a pivotal coupling between the outer end of the piston rod 90 and the swivel bracket 52. The swivel bracket ribs 106 will be described in more detail below.

The piston rod 90 extends and contracts with the reciprocal movement of the piston assembly. Pressurized working fluid within the cylinder assembly 86 produces this reciprocal movement of the piston assembly. The aforenoted powering assembly 87 is provided for powering or pressurizing the working fluid. The powering assembly 87 includes a reversible electric motor 114, a reversible hydraulic pump 116 and a fluid reservoir 118. Both of the electric motor 114 and the reservoir 118 are relatively bulky members. These components are placed in a fluid circuit which will be described below in reference to FIG. 8.

Figure 4:
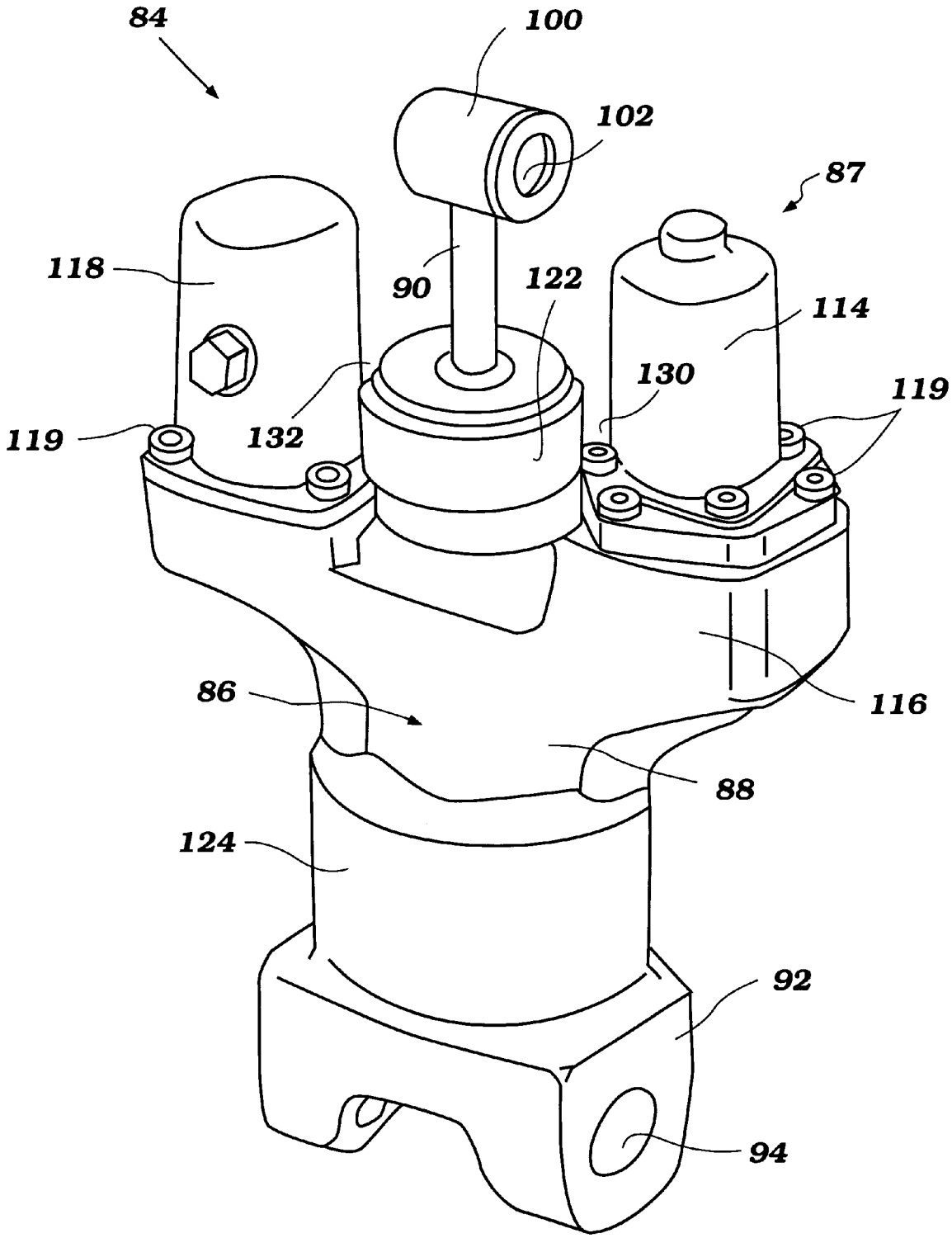
FIG. 4 is a perspective view showing a hydraulic tilt device of the tilt and trim assembly which unifies the cylinder housing and powering members.

As best seen in FIG. 4, the powering assembly 87 is unified with the cylinder assembly 86. In the illustrated embodiment, the hydraulic pump 116 is completely unified with the cylinder housing 88 and both of the electric motor 114 and the reservoir 118 are affixed onto the cylinder housing 88 by bolts 119 at both shoulders of the combined structure. The hydraulic tilt device 84 generally has a cross-shape. That is, the cylinder housing 88 is positioned generally longitudinally or vertically so that the piston rod 90 can extend and contract along the longitudinal axis of the housing. The electric motor 114 and the reservoir 118 are supported on a transverse crosspiece and the hydraulic pump 116 is accommodated in the crosspiece, below the electric motor 114.

The electric motor 114 is disposed between one of the swivel bracket ribs 106 and one of the clamping bracket ribs 80, while the fluid reservoir 118 is disposed between the other one of the swivel bracket ribs 106 and the other one of the clamping bracket ribs 80. Both of the electric motor 114 and the fluid reservoir 118 lie next to one of the upper portions 81 of the clamping bracket ribs 80 when the hydraulic tilt device 84 positions the drive unit 32 in the fully trimmed down position.

Since the electric motor 114 and the reservoir 118, which have similar weights relative to each other, are separately disposed on the both shoulders of the cylinder housing 88, the hydraulic tilt device 84 has good weight balance.

An upper section 122 of the cylinder housing 88 is thinner than the lower section 124. This is because the upper section 122 includes a tilt cavity and the lower section 124 includes a trim cavity. The inner construction of the cylinder assembly 86 will be described below. As seen in FIG. 4, a space 130 is formed between the upper section 122 and the electric motor 114, while another space 132 is formed between the upper section 122 and the reservoir 118. The respective swivel bracket ribs 106 are positioned in the spaces 130, 132, as seen in FIG. 3.

Figure 5:
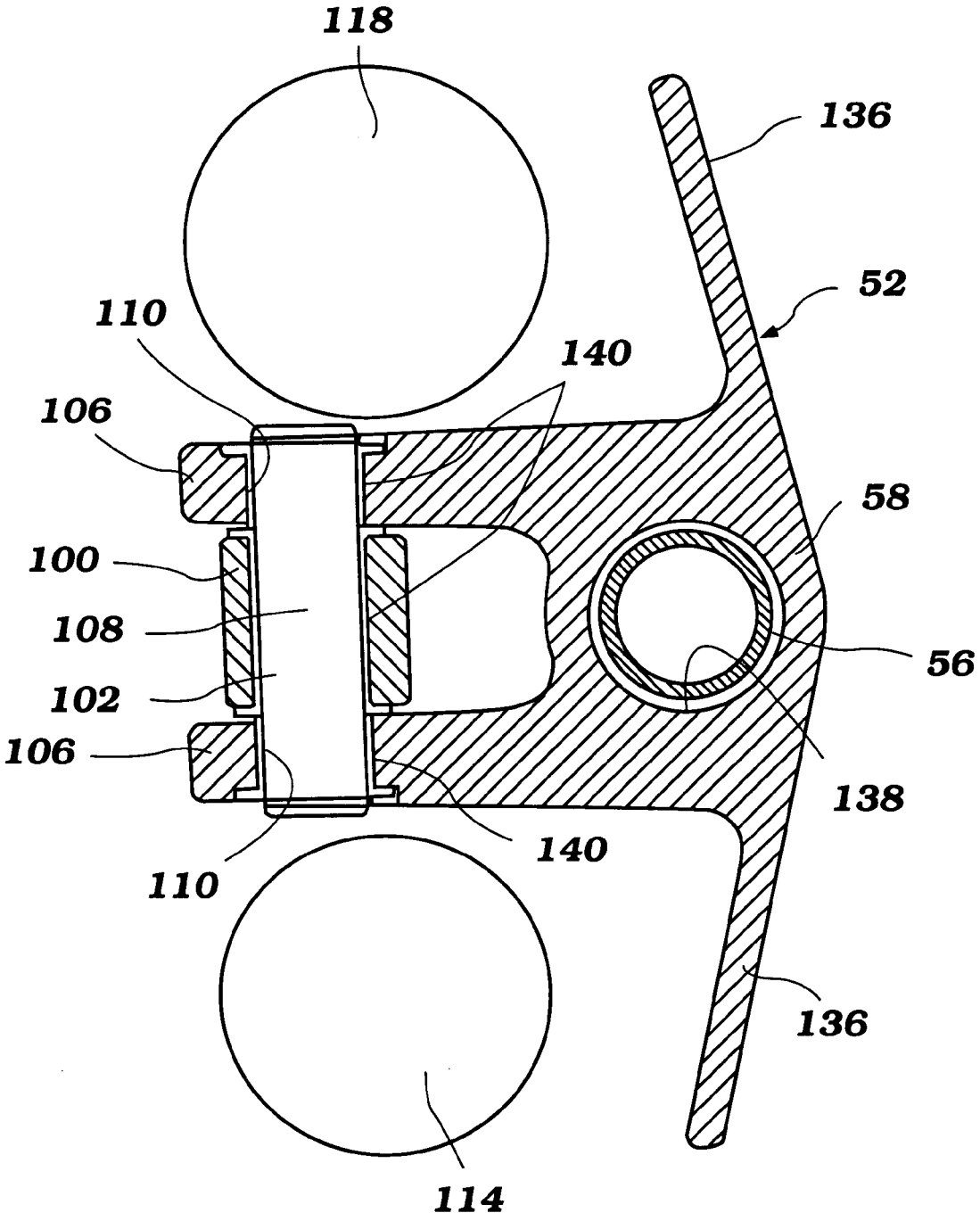
FIG. 5 a cross-sectional plan view taken along the line 5—5 in FIG. 3 showing a pivotal connection between the piston rod and a swivel bracket of the tilt and trim assembly. The powering members are also shown schematically with circles.
Figure 6:
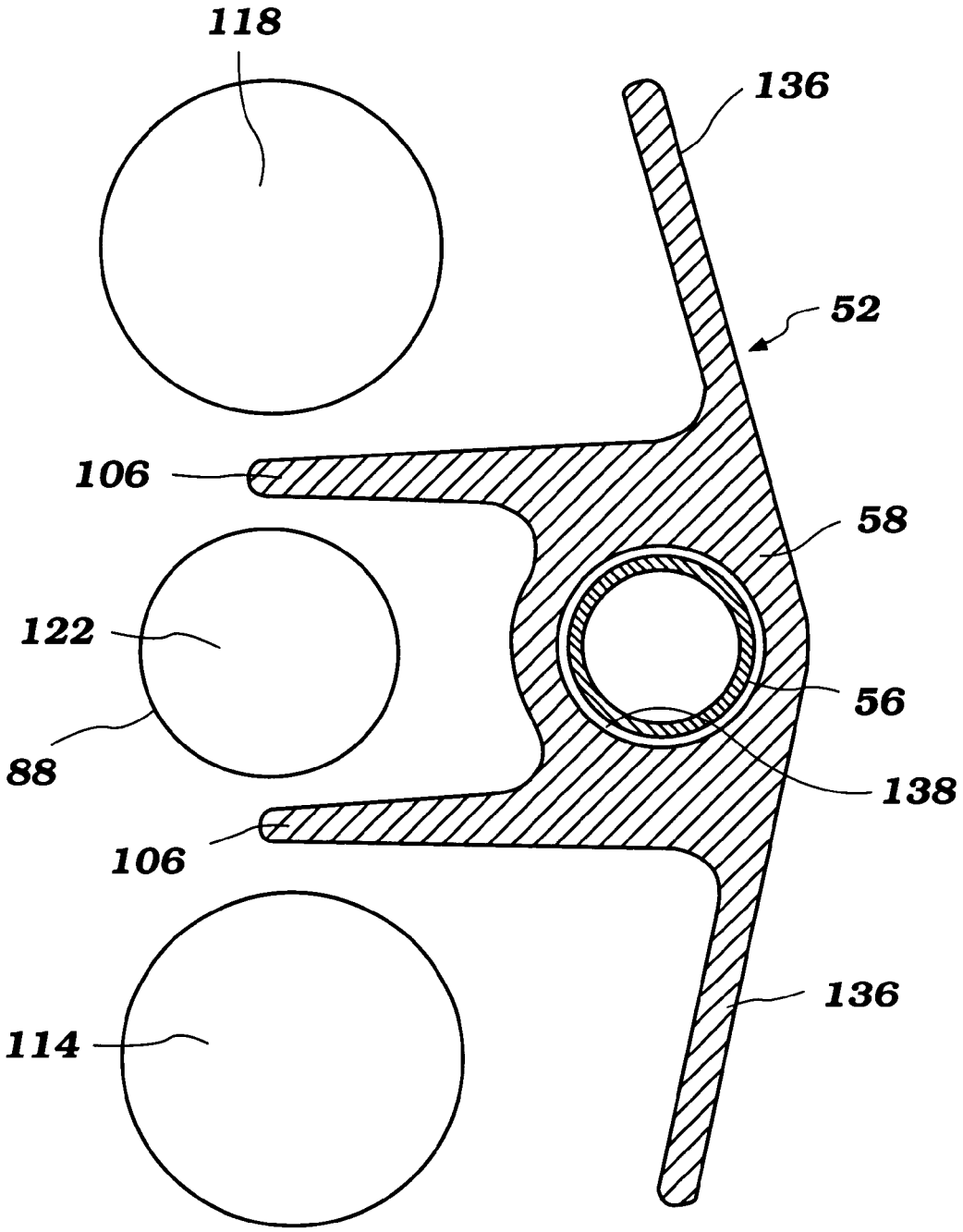
FIG. 6 is a cross-sectional plan view taken along the line 6—6 in FIG. 3 showing the cylinder housing positioned between ribs. The cylinder housing and the powering members are shown schematically with circles.

As best seen in FIGS. 5 and 6, the swivel bracket 52 includes the steering shaft housing section 58, the pair of ribs 106 and a pair of wing-like sections 136. The steering shaft 56 passes through a bore 138 formed in the steering shaft housing section 58. The ribs 106 extend forwardly in parallel to each other. As seen in FIG. 5, the pivot pin 108, which supports the eyelet 100 of the piston rod 94, is journaled by the pair of openings 110 via bushings 140. The electric motor 114 and the fluid reservoir 118 are disposed at both outer sides of the ribs 106 in the proximity thereto. Also, the ribs 106 further extend to a lower position (see FIG. 3), and the upper section 122 of the cylinder housing 88 is disposed between the ribs 106, as seen in FIG. 6.

Figure 2:
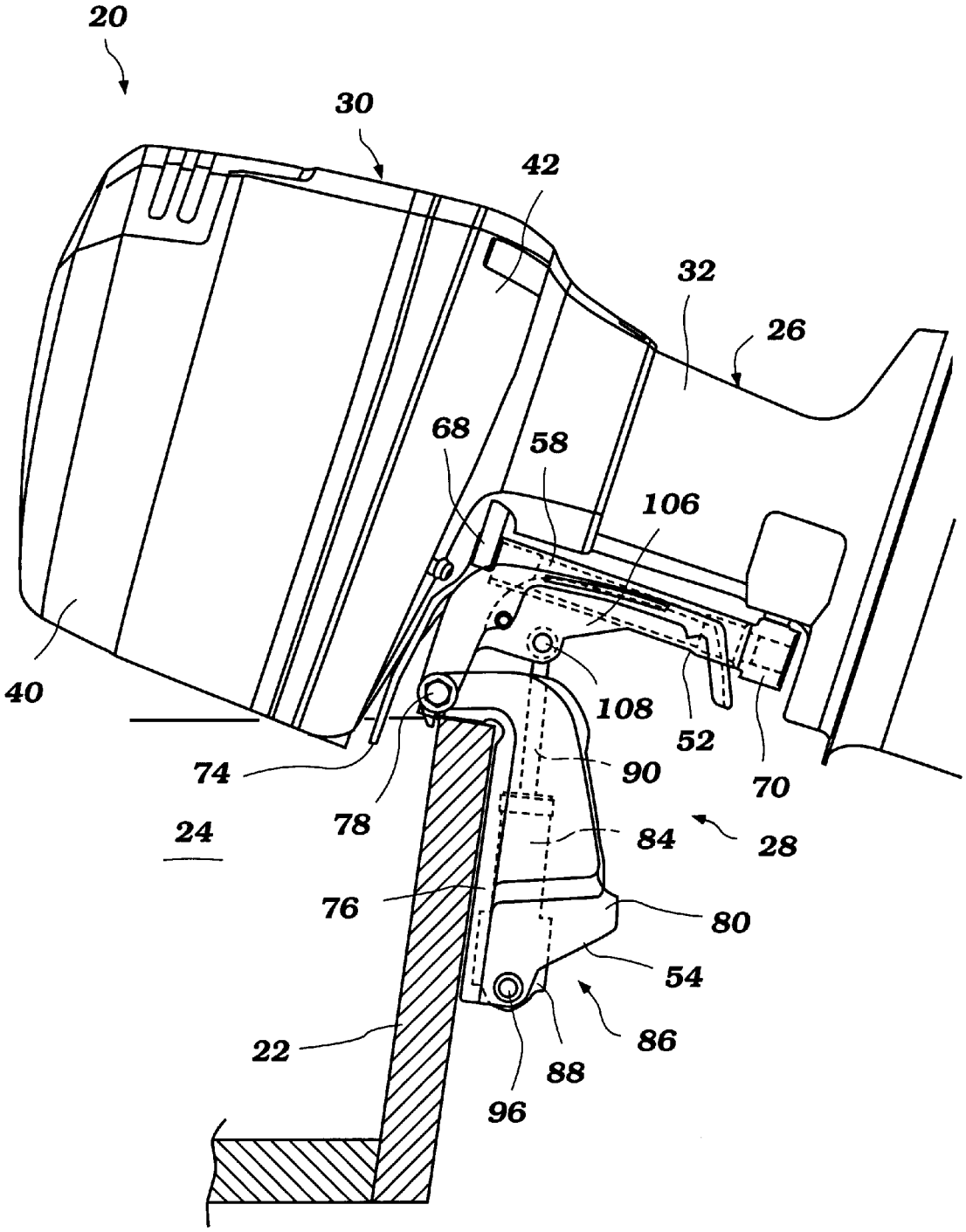
FIG. 2 is partial side elevational view showing the outboard motor of FIG. I in a fully tilted up position.
Figure 7:
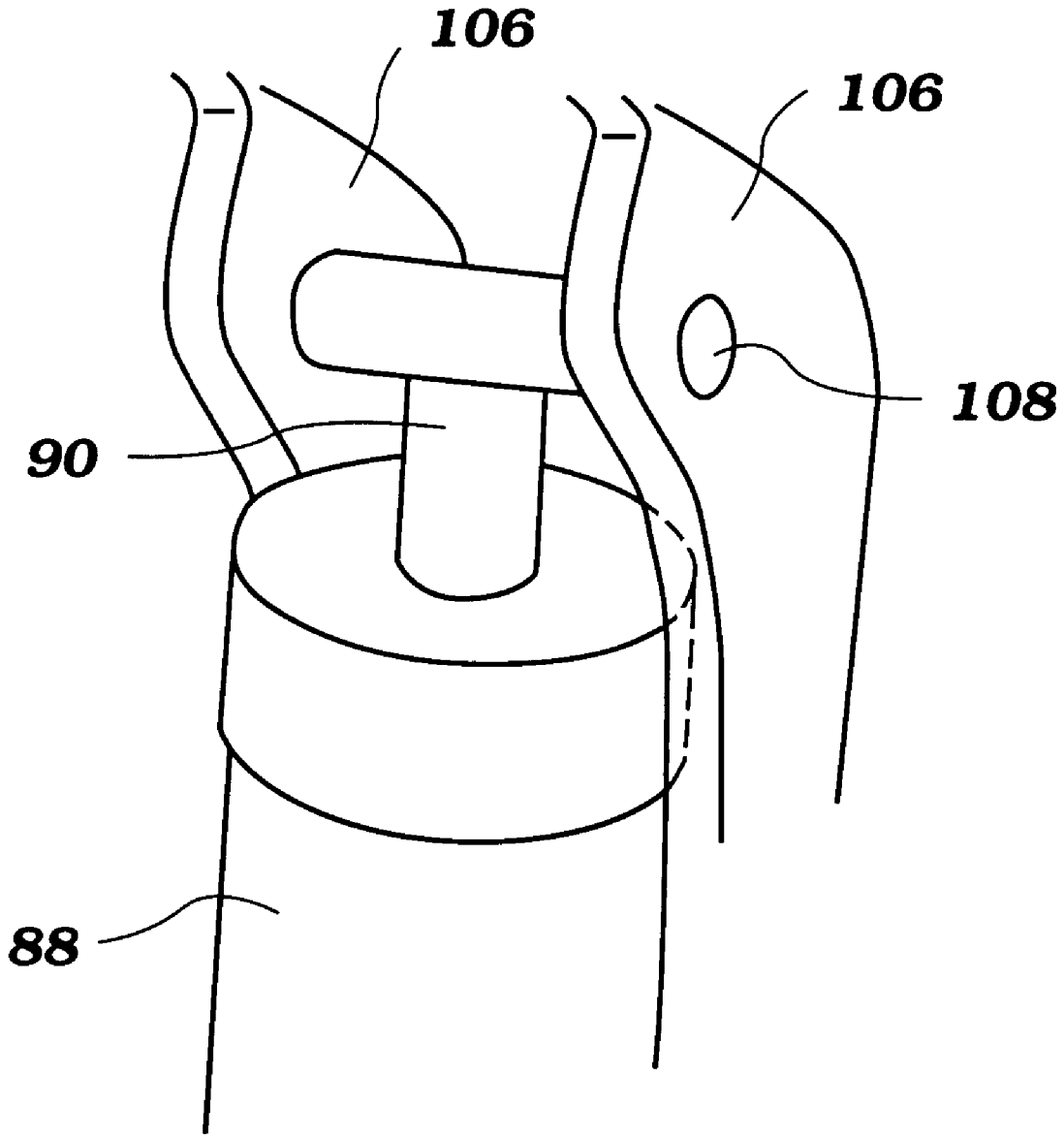
FIG. 7 is a partial perspective view showing the pivotal connection between the piston rod and the ribs of the swivel bracket. The piston rod in this figure exists fully within the cylinder housing.

It should be noted that the upper section 122 of the cylinder housing 88 is generally positioned between the ribs 106 only when the piston rod 90 exists almost fully within the cylinder housing 88. This can be readily understood when FIGS. 1 and 2 are referred in comparison with each other. As seen in FIG. 1, when the drive unit 26 is fully trimmed down, the upper section 122 of the cylinder housing 88 is generally positioned between the respective ribs 106. This situation is also seen in FIG. 7. However, in FIG. 2, when the drive unit 26 is fully tilted up, the upper section 122 of the cylinder housing 88 is moved is completely out from a position between the ribs 109.

As seen in FIG. 3, the tilt and trim arrangement 28 is additionally provided with a trim sensor 142 positioned behind the tilt shaft 78 between the swivel bracket 52 and the clamping bracket 54. The trim sensor 142 senses a trim/tilt angle and sends a signal to a control unit. An electric connector 143 is provided for connecting both of the trim sensor 142 and the electric motor 114 to a battery placed in the hull of the associated watercraft 24 and to the control unit through cables 144, 145.

A tilt lock pin 146 is further provided on the swivel bracket 52. The tilt lock pin 146 has a tilt stopper which can be seated on the top of the clamping bracket 54 to hold the drive unit 26 mechanically at the fully tilted up position when the operator turns a stopper lever.

With reference now to FIGS. 8 through 12, an internal construction of the cylinder assembly 86 and a fluid circuit will be described. The cylinder housing 88 is formed with an upper member 150 and a lower member 152. The upper member 150 has a flange 154 mated with the top end of the lower member 152 and hence both members 150, 152 are unified together at the mated portions in a suitable manner. The upper member 150 generally defines the above noted upper section or the tilt section 122, while the lower member 152 defines the above noted lower section or the trim section 124. An outer diameter of the tilt section 122 is smaller than an outer diameter of the trim section 124.

The cylinder housing 88 defines a housing cavity 156 therein. The housing cavity 156 comprises a tilt cavity 160 and a trim cavity 162. The tilt cavity 160 and the trim cavity 162 are defined in the tilt section 122 and the trim section 124, respectively. An inner diameter of the tilt cavity 160 is smaller than an inner diameter of the trim cavity 162.

A piston assembly 164 is slidably supported in the housing cavity 156. The piston assembly 164 comprises a tilt piston 166, a trim piston 168. In this embodiment, a floating piston 170 is additionally provided between the tilt piston 166 and the trim piston 168. The floating piston moves along with the tilt piston 166 in regular operations, but stays separately from the tilt piston 166 at a position where it is if the drive unit 26 strikes an underwater obstacle. The floating piston 170 thus memorizes the position of the tilt piston 166 before the collision to permit the drive unit 26 to return to the desired tilt/trim position, as described in greater detail below. The piston rod 90 is affixed to the tilt piston 166 and extends through and beyond the tilt cavity 160.

The trim piston 168 has a larger diameter than a diameter of the tilt piston 166 because the trim piston 168 must work against the thrust force generated by the propeller 44 in addition to the weight of the outboard motor 20. The tilt piston 166 in comparison only receives the weight of the outboard motor 20. Thus, the diameter of the tilt piston 166 can be smaller than the diameter of the trim piston 168. The inner diameter of the tilt cavity 160 thus is smaller than the inner diameter of the trim cavity 162, and the outer diameter of the tilt section 122 is smaller than the outer diameter of the trim section 124.

The tilt section member 150 has a circular portion 172 that protrudes into the trim section member 152 and is tightly fitted therein to seal the housing cavity 156. A circular projection 174 extends farther into the trim cavity 162. An outer diameter of the circular projection 174 is smaller than an outer diameter of the circular portion 172. A pocket 176 is, therefore, formed between an outer surface of the circular projection 174 and an inner surface of the trim section member 152. The circular portion 172, the circular projection 174 and the other portion of the tilt section member 150, however, all have the same inner diameters so that the tilt piston 166 and the floating piston 170 can reciprocate therein.

The trim piston 168 has a hollow 180 that can receive the floating piston 170 and the circular projection 174. That is, the hollow 180 has a cup-like shape. An aperture 182 is provided at the bottom of the trim piston 168.

The cooperation between the piston assembly 164 and the housing cavity 156 generally defines a first chamber 186 above the tilt piston 166, a second chamber 188 below the trim piston 168 and a third chamber 190 between the floating piston 170 and the trim piston 168. The second chamber 188 and the third chamber 190 can communicate with each other through the aperture 182 when the floating piston 170 moves away from the trim piston 168.

Figure 8:
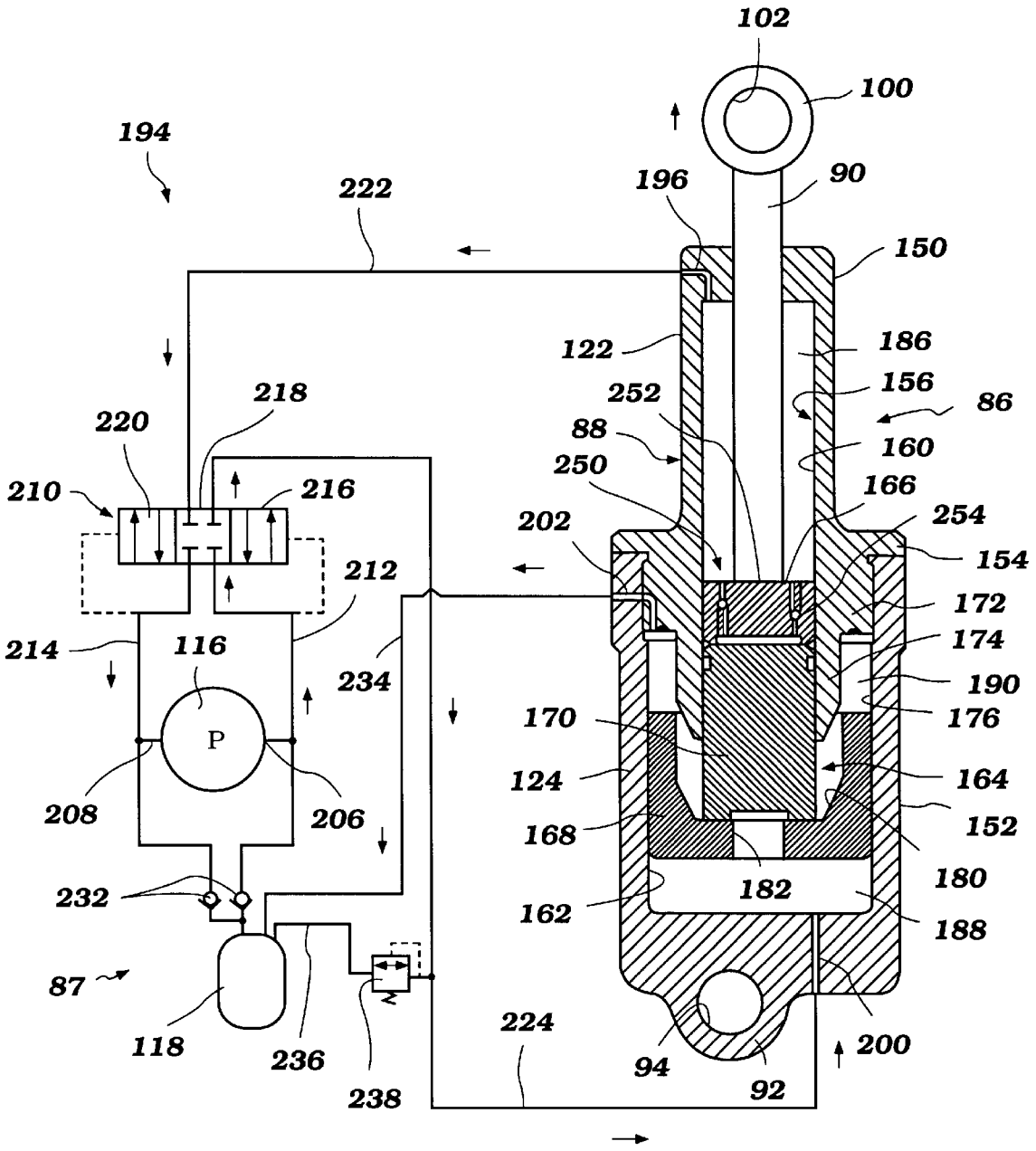
FIG. 8 is a cross-sectional view showing the cylinder assembly taken along its longitudinal axis and also a diagrammatic view showing a fluid circuit in connection with a cylinder assembly. Arrows laid along respective passages indicate a direction of the fluid flow for the extension of the piston rod.

A fluid control circuit 194 is provided outside of the cylinder housing 88 as also shown in FIG. 8. At least some of the fluid passages and valving arrangements desirably are formed within the cylinder assembly 86 to minimize external conduits and make the trim device 84 compact.

The tilt section member 150 has a passage 196 at the top portion thereof. The passage 196 is opened to the first chamber 186. The trim section member 152 has another passage 200 at the bottom portion thereof. This passage 200 is opened to the second chamber 188. A third passage 202 is further provided to extend through the circular portion 172 of the tilt section member 150 and through an upper portion of the trim section member 152. The third passage 202 communicates with the third chamber 190.

The reversible hydraulic pump 116 is provided in the fluid circuit 194. The hydraulic pump 116 has two ports 206, 208 which alternatively will be an inlet port and an outlet port in response to changes of rotational directions of the hydraulic pump 116. Both ports 206, 208 communicate to one side of a three-way valve 210 through delivery passages 212, 214, respectively. The three-way valve 210 includes an expansion section 216, a shut down section 218 and a contraction section 220 which are interchangeable by the operator in a suitable manner. The passage 196 in the tilt section member 150 and the passage 200 in the trim section member 152 are connected to the other side of the three-way valve 210 through a passage 222 and another passage 224, respectively. The movement of the valve between these three positions can be accomplished automatically by a mechanical valve or can be an actuator mechanism to move the valve between positions, as well known in the art.

The ports 206, 208 of the hydraulic pump 116 also communicate with the fluid reservoir 118 through passages 228, 230. The respective passages 228, 230 incorporate check valves 232 which permit fluid flowing from the reservoir 118 to the hydraulic pump 116 but prevent reverse flow. The passages 228, 230 are united together to be a single passage and then connected to the reservoir 118. The passage 202 of the cylinder housing 88, which communicates with the third chamber 190, is connected to the reservoir 118 through a passage 234. One more passage 236 is provided between the reservoir 118 and the passage 224. A relief valve 238 is placed within the passage 236 so as to permit the fluid flowing to the reservoir 118 in the event that the fluid pressure in the passage 224 becomes higher than a preset magnitude.

As also seen in FIG. 8, the tilt piston 166 includes a shock absorber mechanism 250 to permit the drive unit 26 to pop up when an underwater obstacle is struck and to return to its trimmed/tilted position when the underwater obstacle is cleared. For this purpose, the shock absorber mechanism 250 has an absorber valve 252 and a return valve 254 in the tilt piston 166. The floating piston 170 memorizes the initial trim/tilt position of the tilt piston 166 immediately before the pop up action.

Figure 9:
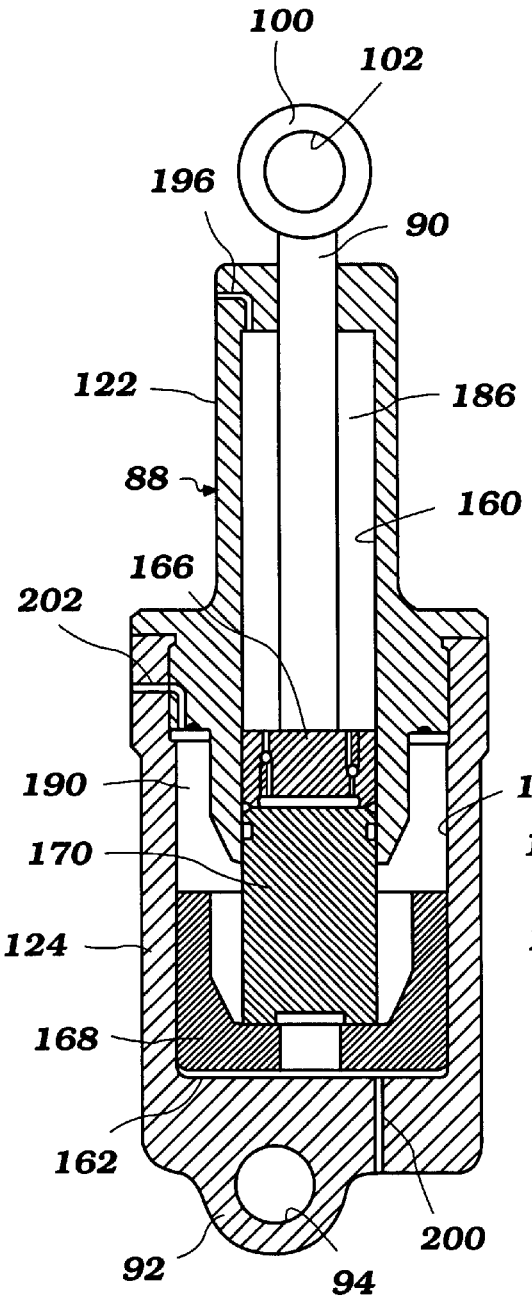
FIG. 9 is a cross-sectional view showing the cylinder assembly in which a piston assembly is in a fully trimmed down position with the piston rod existing almost fully within the cylinder housing of the cylinder assembly.

In operation, at first, the drive unit 26 is fully trimmed down position as shown in FIG. 1 and the cylinder assembly 86 is in the situation shown in FIG. 9. When a trim adjustment action is started, the expansion section 216 of the three-way valve 210 is selected so that the passages 222, 224 communicate with the passages 214, 212 in the directions as schematically indicated in FIG. 8 by the arrows in the box of the section 216. The hydraulic pump 116 is operated by the electric motor 114 to push the working fluid toward the passage 224. The fluid flows in the passage 224 and then enters the second chamber 188 of the trim cavity 162 through the passage 200. The fluid pushes the trim piston 168 upwardly. The piston assembly 164 moves up as a unit accordingly. The fluid in the third chamber 190 is displaced to the reservoir 118 through the passage 202 and the passage 234. The fluid in the first chamber 186, in turn, is also displaced by the upward movement of the piston assembly 164 to the passage 222 through the passage 196. The fluid then returns to the hydraulic pump 116 through the three-way valve 210 and the passage 214. Thus, the piston rod 90 extends from the first chamber 186 to lift the drive unit 26 upwardly in the trim adjusted range. The fluid displacement of the piston rod 90 which has extended from the cylinder housing 86 is compensated or filled with the fluid coming from the reservoir 118 through the check valve 232.

Figure 10:
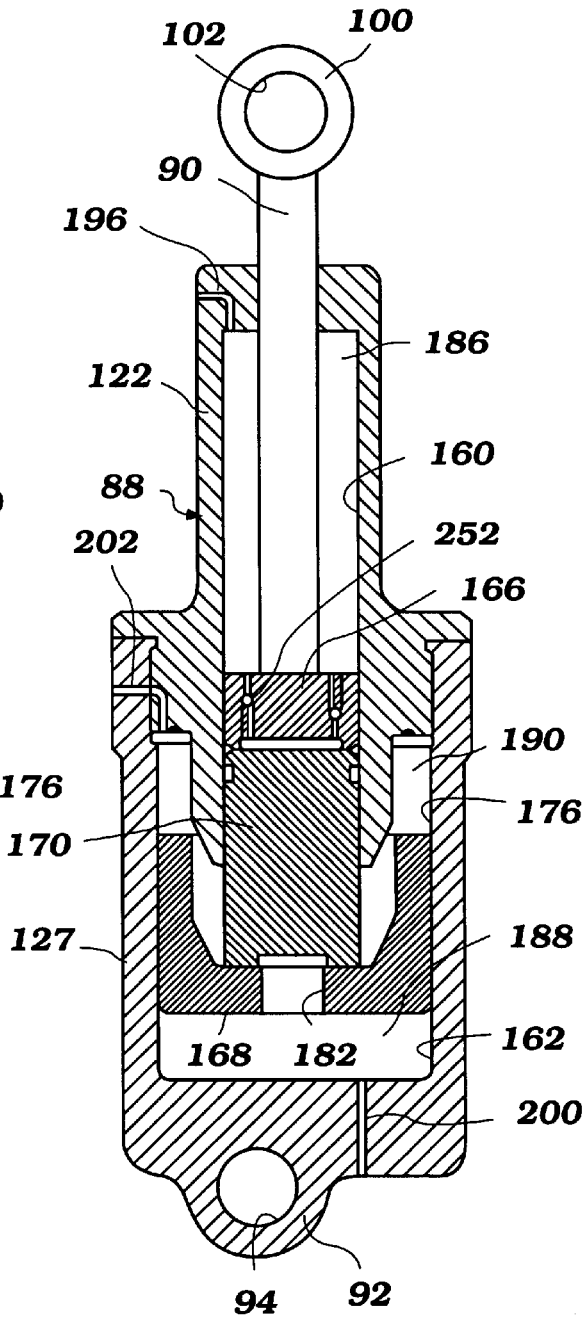
FIG. 10 is a cross-sectional view showing the cylinder assembly in which the piston assembly is in a trim adjusted area.

The trim piston 168 can be held at any position in the trim cavity 162 as shown in FIG. 10 by switching over the three-way valve 210 from the expansion section 216 to the shut down section 218. The hydraulic pump 116 is of course not operated under this condition. The drive unit 26 is thus maintained at a certain trim adjusted position established by the trim device 84.

Figure 11:
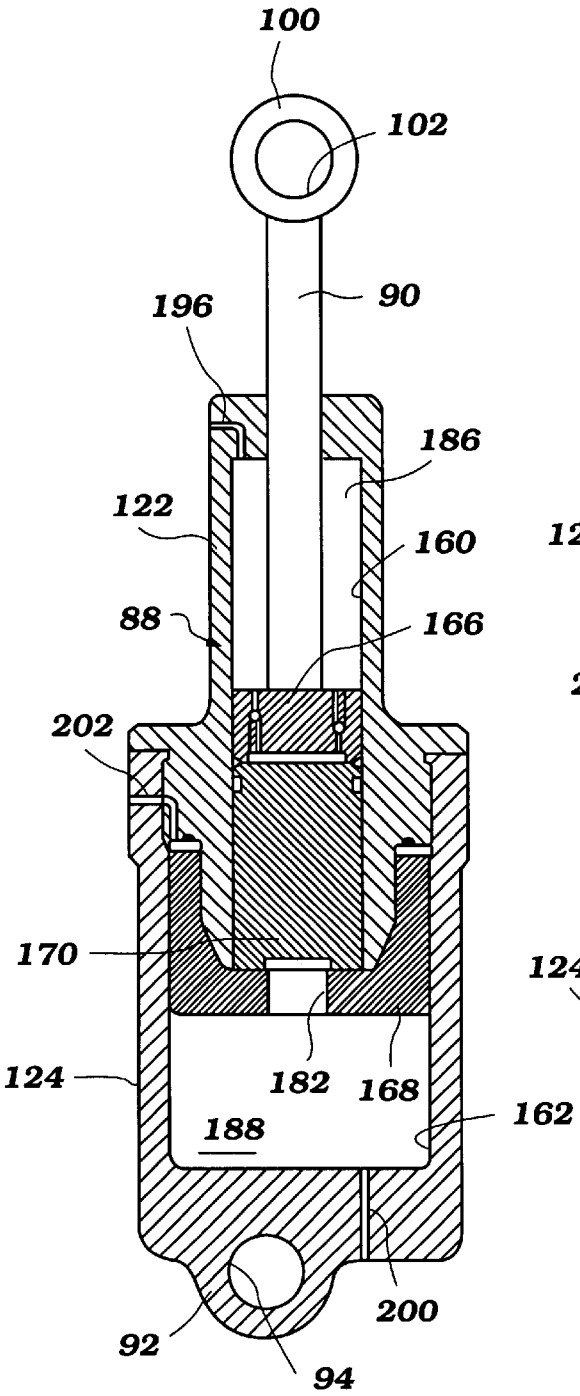
FIG. 11 is a cross-sectional view showing the cylinder housing in which the piston assembly is in a fully trimmed up position.

If the operator desires to raise the drive unit 26 toward the fully trimmed up position, communication between the expansion section 216 of the three-way valve 210, the communication line 224, and the hydraulic pump 116 is maintained while the pump is operated. The working fluid is thus continuously supplied to the second chamber 188 and the piston assembly 164 still moves upward. The trim piston 168 is then stopped when the trim piston 168 abuts the circular position 172 of the tilt section member 150. In this position, the hollow 180 of the trim position 168 receives the circular projection 174. This situation is shown in FIG. 11. At this position of the trim piston 168, the drive unit 26 is fully trimmed up.

Figure 12:
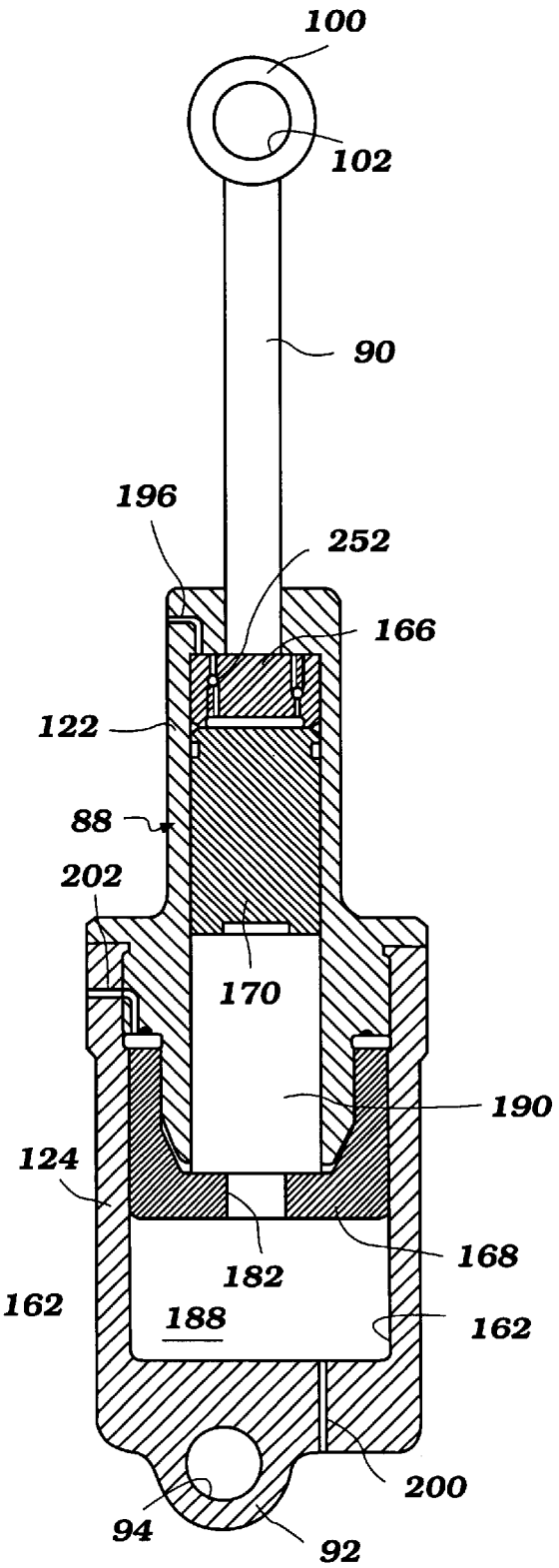
FIG. 12 is a cross-sectional view showing the cylinder housing in which the piston assembly is in a fully tilted up position with the piston rod extending almost fully out the cylinder housing.

If the operator desires to raise the drive unit 26 further into the tilt range, the expansion section 216 of the three-way valve 210 is kept positioned in the communication line and operation of the hydraulic pump 116 is continued. Although upward movement of the trim piston 168 is now restrained at the top of the trim cavity 162 and the aperture 202 is closed by the trim piston 168, the tilt piston 166 as well as the floating piston 170 still move upwardly as pressurized fluid continues to flow into the second chamber 188. The fluid is supplied to the third chamber 190 through the aperture 182 in the trim piston 168. The fluid in the first chamber 186 is displaced to the hydraulic pump 116 through the same passages involved with the trim adjusting action. The capacity of the piston rod 90 is again compensated by the fluid supplied from the reservoir 118. The tilt piston 166 upward travel continues until the piston 166 reaches the top of the tilt cavity 160 as shown in FIG. 12. At this position of the tilt piston 166, the drive unit 26 is placed at the fully tilted up position as shown in FIG. 2.

If the operator desires to lower the drive unit 26, the three-way valve 210 is switched to the contraction section 220 and the electric motor 114 runs in reverse. With this reversed rotation of the electric motor 114, the hydraulic pump 116 also functions in reverse. The movement of the piston assembly 164 in this reversed operation is completely reverse of the operation described above. That is, the tilt piston 166 as well as the floating piston 170 move down, without movement of the trim piston 168, in the tilt cavity 156, and then with the trim piston 168 when it can move in the trim cavity 162. With this movement of the piston assembly 164, the piston rod 90 retracts into the housing cavity 156 and the drive unit 26 is tilted down and/or trimmed down. The fluid which has compensated the fluid displacement of the piston rod 90 returns to the reservoir 11 8 through the passage 202 and the passage 234 in this downward movement.

In the event that an underwater obstacle is struck to the drive unit 26 when the drive unit 26 is at a trim adjusted position, huge pressure is generated in the first chamber 186 because the piston rod 90 is pulled instantaneously upwardly with enormous force. However, the pressure will be relieved by the shock absorber mechanism 250. That is, the fluid in the first chamber 186 immediately passes through the shock absorber valve 252 to the space between the tilt piston 166 and the floating piston 170. The piston rod 90 hence can extend rapidly. The floating piston 170 remains at the trim adjusted position to memorize this initial position of the tilt piston 166. When the underwater obstacle is cleared, the fluid in the space between the tilt piston 166 and the floating piston 170 returns to the first chamber 186 through the return valve 254. The tilt piston 166 then returns to the initial position memorized by the floating piston 170. Accordingly, the trim adjusted position of the drive unit 26 is continuously maintained.

As described above, the diameter of the tilt section 122 is smaller than the diameter of the trim section 124. The tilt section 122 can be well placed between the ribs 106. Because of this, the ribs 106 can be elongated as long as possible so as to have sufficient rigidity. The ribs 106, therefore, can withstand a relatively large thrust force and will not be distorted by such force and by the weight of the drive unit 32. In addition, the ribs 106 and the tilt section 122 of the cylinder housing 88 do not interfere with each other. Thus, the tilt and trim arrangement 28 is kept compact.

The facets of the present invention can be applied to other marine propulsions such as outboard drive sections of inboard motors, as noted above. Of course, the foregoing description is that of a preferred embodiment of the invention, and various changes and modifications may be made without departing from the spirit and scope of the invention, as defined by the appended claims.

What is claimed is:

1. A tilt and trim arrangement for a marine outboard drive comprising a swivel bracket carrying a drive unit for pivotal movement about a generally vertically extending axis, said swivel bracket including a pair of ribs spaced apart transversely from each other, a clamping bracket adapted to be affixed to an associated watercraft and supporting said swivel bracket for pivotal movement about a generally horizontally extending axis, a hydraulic tilt device including a cylinder housing defining a cavity therein, a piston assembly slidably disposed within said cavity, and a piston rod affixed to said piston assembly and extending beyond said cavity, said cylinder housing including a tilt section and a trim section, an outer diameter of said tilt section being smaller than an outer diameter of said trim section, said piston rod extending within said tilt section, a first pivotal connection arranged between said piston rod and said ribs so as to be disposed generally between said ribs, a second pivotal connection arranged between said cylinder housing and said clamping bracket, and a distance between the respective ribs being shorter than the outer diameter of said trim section.

2. A tilt and trim arrangement as set forth in claim 1, wherein said hydraulic tilt device further includes a hydraulic pump for supplying pressurized working fluid to said cavity, and an electric motor for driving said hydraulic pump, said electric motor being disposed laterally outward of said ribs.

3. A tilt and trim arrangement as set forth in claim 2, wherein said clamping bracket includes a pair of second ribs, one of said second ribs is spaced apart transversely from one of said first ribs to define a space therebetween, and said electric motor is positioned within said space.

4. A tilt and trim arrangement as set forth in claim 3, wherein another one of said second ribs is spaced apart transversely from another one of said first ribs to define a second space therebetween, and said fluid reservoir is positioned within said second space.

5. A tilt and trim arrangement as set forth in claim 4, wherein a distance between portions of said second ribs that define said first and second spaces is longer than a distance between the rest of the respective second ribs.

6. A tilt and trim arrangement as set forth in claim 2, wherein said hydraulic pump is unified with said cylinder housing.

7. A tilt and trim arrangement as set forth in claim 2, wherein said hydraulic tilt device additionally comprises a fluid reservoir for containing the working fluid, and the fluid reservoir is disposed laterally outward of said ribs at a side opposite said electric motor.

8. A tilt and trim arrangement as set forth in claim 7, wherein at least one of said electric motor and said fluid reservoir is unified with said cylinder housing.

9. A tilt and trim arrangement as set forth in claim 1, wherein said clamping bracket includes a pair of second ribs, said cylinder housing extends between both the second ribs and at generally equal distance from the respective second ribs.

10. A tilt and trim arrangement for a marine outboard drive comprising a swivel bracket carrying a drive unit for pivotal movement about a generally vertically extending axis, said swivel bracket including a pair of ribs spaced apart transversely from each other, a clamping bracket adapted to be affixed to an associated watercraft and supporting said swivel bracket for pivotal movement about a generally horizontally extending axis, a tilt and trim device including a housing having a tilt section and a trim section, an outer diameter of said tilt section being smaller than an outer diameter of said trim section, said tilt section defining a tilt cavity and having a tilt piston slidably movable within said tilt cavity, said trim section defining a trim cavity and having a trim piston slidably movable only within said trim cavity, an inner diameter of said tilt cavity being smaller than an inner diameter of said trim cavity, a piston rod affixed to said tilt piston and extending beyond said tilt cavity, a first pivotal connection arranged between said piston rod and said ribs so as to be disposed generally between the respective ribs, a second pivotal connection arranged between said cylinder and said clamping bracket, both of said trim piston and said tilt piston moving as a unit to shift said drive unit in a trim range and only said tilt piston moving in a tilt range, and a distance between the respective ribs being shorter than the outer diameter of said trim section.

11. A tilt and trim arrangement as set forth in claim 10, wherein said first pivotal connection is positioned generally between said ribs.

12. A tilt and trim arrangement as set forth in claim 10, wherein said tilt and trim device further includes a hydraulic assembly for supplying pressurized working fluid to said tilt cavity and said trim cavity, and said hydraulic assembly has at least two components disposed at either outer side of said ribs.

13. A tilt and trim arrangement as set forth in claim 10, wherein said trim piston has an aperture through which working fluid passes when said tilt piston moves separately from said trim piston.

14. A tilt and trim arrangement for a marine outboard drive comprising a swivel bracket carrying a drive unit for pivotal movement about a vertically extending steering axis, said swivel bracket including a pair of first ribs spaced apart transversely from each other, a clamping bracket adapted to be affixed to an associated watercraft and supporting said swivel bracket for pivotal movement about a horizontally extending tilt axis, said clamping bracket including a pair of second ribs spaced apart transversely from each other, a tilt and trim device placed between said swivel bracket and said clamping bracket for tilting said swivel bracket, said tilt and trim device including a cylinder housing defining a cavity therein, a piston slidably disposed within said cavity, and a piston rod affixed to said piston, said cylinder housing having a lower section and an upper section, an outer diameter of said upper section is smaller than an outer diameter of said lower section, said piston rod extending outwardly from said upper section and being affixed to said first ribs for pivotal movement, said lower section being affixed to said second ribs, and said outer diameter of said lower section being longer than a distance between the respective first ribs.

15. A hydraulic tilt and trim assembly for a marine outboard drive comprising a swivel bracket arranged to support a drive unit for pivotal movement about a generally vertically extending axis, the swivel bracket including a pair of ribs spaced apart transversely from each other, a clamping bracket adapted to be affixed to an associated watercraft and arranged to support the swivel bracket for pivotal movement about a generally horizontally extending axis, a cylinder housing defining an inner cavity, a piston slidably disposed within the inner cavity, a piston rod affixed to the piston and extending beyond the inner cavity, a hydraulic pump arranged to supply working fluid to the inner cavity, an electric motor driving the hydraulic pump, and a fluid reservoir arranged to contain the working fluid, one of the piston rod and the cylinder housing being coupled with the ribs for pivotal movement, the other one of the piston rod and the cylinder housing being coupled with the clamping bracket for pivotal movement, a portion of one of the ribs being interposed between the cylinder housing and the electric motor when the piston rod exists generally fully within the cylinder housing, a portion of the other rib being interposed between the cylinder housing and the fluid resovoir when the piston rod exists generally within the cylinder housing.

16. A hydraulic tilt and trim assembly as set forth in claim 15, wherein the clamping bracket includes a pair of second ribs, the other one of the piston rod and the cylinder housing is coupled with the second ribs, and the electric motor is interposed generally between one of the first ribs and one of the second ribs.

17. A hydraulic tilt and trim assembly for a marine outboard drive comprising a swivel bracket arranged to support a drive unit for pivotal movement about a generally vertically extending axis, the swivel bracket including a pair of ribs spaced apart transversely from each other, a clamping bracket adapted to be affixed to an associated watercraft and arranged to support the swivel bracket for pivotal movement about a generally horizontally extending axis, a cylinder housing defining an inner cavity, a piston slidably disposed within the inner cavity, a piston rod affixed to the piston and extending beyond the inner cavity, a hydraulic pump arranged to supply working fluid to the inner cavity, and an electric motor driving the hydraulic pump, a fluid reservoir arranged to contain the working fluid, one of the piston rod and the cylinder housing being coupled with the ribs for pivotal movement, the other one of the piston rod and the cylinder housing being coupled with the clamping bracket for pivotal movement, and a portion of one of the ribs being interposed between the cylinder housing and the fluid reservoir when the piston rod exists generally fully within the cylinder housing.

18. A hydraulic tilt and trim assembly as set forth in claim 17, wherein a portion of the other rib is interposed between the cylinder housing and the electric motor when the piston rod exists generally fully within the cylinder housing.

19. A hydraulic tilt and trim assembly as set forth in claim 17, wherein the clamping bracket includes a pair of second ribs, the other one of the piston rod and the cylinder housing is coupled with the second ribs, and the fluid reservoir is interposed generally between one of the first ribs and one of the second ribs.

20. A hydraulic tilt and trim assembly for a marine outboard drive comprising a swivel bracket arranged to support a drive unit for pivotal movement about a generally vertically extending axis, the swivel bracket including a pair of ribs spaced apart transversely from each other, a clamping bracket adapted to be affixed to an associated watercraft and arranged to support the swivel bracket for pivotal movement about a generally horizontally extending axis, a cylinder housing defining an inner cavity, a piston slidably disposed within the inner cavity, a piston rod affixed to the piston and extending beyond the inner cavity, and a hydraulic unit arranged to supply working fluid to the inner cavity, the hydraulic unit including at least two components, one of the piston rod and the cylinder housing being coupled with the first ribs for pivotal movement, the other one of the piston rod and the cylinder housing being coupled with the clamping bracket for pivotal movement, a portion of one of the ribs being interposed between the cylinder housing and one of the components when the piston rod exists generally fully within the cylinder housing, and a portion of the other rib being interposed between the cylinder housing and the other component when the piston rod exists generally fully within the cylinder housing.

21. A hydraulic tilt and trim assembly as set forth in claim 20, wherein the clamping bracket includes a pair of second ribs, the other one of the piston rod and the cylinder housing is coupled with the second ribs, and each one of the components is interposed generally between one of the first ribs and one of the second ribs.

22. A hydraulic tilt and trim assembly as set forth in claim, 21, wherein a distance between portions of the second ribs which interpose the components is longer than a distance between the rest of the respective second ribs.

* * * * *